US010535355B2

(12) United States Patent
McDowell et al.

(10) Patent No.: US 10,535,355 B2
(45) Date of Patent: Jan. 14, 2020

(54) FRAME CODING FOR SPATIAL AUDIO DATA

(71) Applicant: MICROSOFT TECHNOLOGY LICENSING, LLC, Redmond, WA (US)

(72) Inventors: Brian C. McDowell, Redmond, WA (US); Philip Andrew Edry, Seattle, WA (US); Ziyad Ibrahim, Redmond, WA (US); Robert Norman Heitkamp, Sammamish, WA (US); Steven Wilssens, Kenmore, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/609,418

(22) Filed: May 31, 2017

(65) Prior Publication Data

US 2018/0144752 A1 May 24, 2018

Related U.S. Application Data

(60) Provisional application No. 62/424,242, filed on Nov. 18, 2016.

(51) Int. Cl.

| | |
|---|---|
| ***G10L 19/008*** | (2013.01) |
| ***H04S 3/00*** | (2006.01) |
| ***H04S 7/00*** | (2006.01) |

(52) U.S. Cl.

CPC ..... *G10L 19/008* (2013.01); *H04S 3/008* (2013.01); *H04S 7/301* (2013.01)

(58) Field of Classification Search

None

See application file for complete search history.

(56) References Cited

U.S. PATENT DOCUMENTS

| | | | |
|---|---|---|---|
| 9,257,127 | B2 | 2/2016 | Beack et al. |
| 2006/0259168 | A1 | 11/2006 | Geyersberger et al. |

(Continued)

FOREIGN PATENT DOCUMENTS

| | | | |
|---|---|---|---|
| WO | 2012122397 | A1 | 9/2012 |
| WO | 2015017914 | A1 | 2/2015 |
| WO | WO2016/050900 | A1 * | 4/2016 |

OTHER PUBLICATIONS

Thomas, "Presenting Spatial Audio!", https://developer.jabra.com/presenting-spatial-audio/, Published on: Sep. 14, 2016, 7 pages.

(Continued)

*Primary Examiner* — James K Mooney

(74) *Attorney, Agent, or Firm* — Newport IP, LLC; Scott Y. Shigeta; Tim R. Wyckoff

(57) ABSTRACT

The techniques disclosed herein provide apparatuses and related methods for the communication of spatial audio and related metadata. In some implementations, a source provides prerecorded spatial audio that has embedded metadata. A computing device processes the prerecorded spatial audio to generate an audio codec that is segmented to include a first section of audio data and a second section that includes metadata extracted from the prerecorded spatial audio. The generated audio codec may be received by a device that includes an encoder. The encoder may process the generated audio codec to generate audio data that includes the metadata.

19 Claims, 5 Drawing Sheets

(56) References Cited

U.S. PATENT DOCUMENTS

| | | | |
|---|---|---|---|
| 2009/0080632 | A1 | 3/2009 | Zhang et al. |
| 2015/0146873 | A1 | 5/2015 | Chabanne et al. |
| 2015/0228286 | A1 | 8/2015 | Hooks et al. |
| 2015/0235645 | A1 | 8/2015 | Hooks et al. |
| 2015/0372820 | A1 | 12/2015 | Schneider et al. |
| 2016/0021476 | A1 | 1/2016 | Robinson et al. |
| 2016/0134988 | A1 | 5/2016 | Gorzel et al. |
| 2016/0142846 | A1 | 5/2016 | Herre et al. |
| 2016/0212272 | A1 | 7/2016 | Srinivasan et al. |
| 2016/0219387 | A1* | 7/2016 | Ward ..... G10L 19/008 |

OTHER PUBLICATIONS

Cohen, David, "Audio 360: Facebook Brings Spatial Audio to 360-Degree Videos", http://www.adweek.com/socialtimes/audio-360/645873, Published on: Oct. 7, 2016, 8 pages.

"Use spatial audio in 360-degree and VR videos", https://support.google.com/youtube/answer/6395969?hl=en, Retrieved on: Dec. 2, 2012, 3 pages.

Rutkas, Clint, ""Throwing your voice" with Spatial Audio", https://blogs.windows.com/buildingapps/2016/09/15/throwing-your-voice-with-spatial-audio/, Published on: Sep. 15, 2016, 23 pages.

"International Search Report and Written Opinion Issued in PCT Application No. PCT/US2017/061215", dated Jan. 30, 2018, 11 Pages.

* cited by examiner

FRAME CODING FOR SPATIAL AUDIO DATA

CROSS REFERENCE TO RELATED APPLICATION

This patent application claims the benefit of U.S. Provisional Patent Application Ser. No. 62/424,242 filed Nov. 18, 2016, entitled "ENHANCED PROCESSING OF SPATIAL AUDIO DATA," which is hereby incorporated in its entirety by reference.

BACKGROUND

Some entertainment systems (e.g., televisions and surround sound systems), high fidelity speaker systems, headphones, and software applications may process object-based audio to utilize one or more spatialization technologies. For instance, entertainment systems may utilize a spatialization technology, such as Dolby Atmos, to generate a rich sound that enhances a user's experience of a multimedia presentation.

The spatial presentation of audio utilizes audio objects, which are audio signals with associated parametric source descriptions of position, such as three-dimensional coordinates, gain, such as volume level, and other parameters. Object-based audio is increasingly being used for many multimedia applications, such as digital movies, video games, simulators, streaming video and audio content, and three-dimensional video. The spatial presentation of audio may be particularly important in a home environment where the number of reproduction speakers and their placement is generally limited or constrained.

Some spatial audio formats utilize conventional channel-based speaker feeds to deliver audio to an endpoint device, such as a plurality of speakers or headphones. In addition, the spatial audio format may utilize a separate audio objects feed that is used by an encoder to create an immersive three-dimensional audio reproduction over the plurality of speakers or headphones. In one example, the encoder device combines at least one audio object, such as a positional trajectory object for a three-dimensional space, such as a room or other environment, with audio content to provide the immersive three-dimensional audio reproduction over the plurality of speakers or headphones.

The conventional technique for providing a separate audio objects feed that includes the audio objects for a plurality of channel-based speaker feeds creates inefficiencies at the encoder that combines the audio content and the audio objects for distribution to the plurality of speakers or headphones. For example, some digital cinema systems use up to 16 separate audio channels that are fed to individual speakers of a multimedia entertainment system. The separate audio objects feed is used to transport the plurality of audio objects that are associated with each of the separate audio channels. The encoder is to quickly and efficiently parse the separate audio objects feed to extract the plurality of audio objects. Then, the encoder is to combine the extracted plurality of audio objects with the separate audio channels for reproduction using a digital cinema system or reproduction over headphones. The audio associated with the separate audio channels may be carried in codec frames. Each of the codec frames may have a plurality of audio objects (e.g., 3-5 audio objects) carried in the separate audio objects feed (i.e., objects frame). Therefore, the encoder is to be computationally capable of quickly and efficiently extracting up to 80 audio objects from the separate audio objects feed and combining the extracted audio objects with the separate audio channels. The extraction and combining performed by the encoder generally occurs in a very short time duration (e.g., 32 ms).

The above described conventional technique for providing a separate audio objects feed that includes the audio objects for a plurality of channel-based speaker feeds necessitates the use of significant computational resources by the encoder. The use of significant computational resources by the encoder increases implementation costs associated with multimedia entertainment systems. Furthermore, the current conventional technique that provides the separate audio objects feed for the plurality of channel-based speaker feeds may not be viably scalable for use with channel-based speaker feeds implemented by future multimedia entertainment systems.

It is with respect to these and other considerations that the disclosure made herein is presented.

SUMMARY

The techniques disclosed herein provide apparatuses and related methods for the communication of spatial audio and related metadata. In some implementations, a source provides prerecorded spatial audio that has embedded metadata. A computing device processes the prerecorded spatial audio to generate an audio codec that is segmented to include a first section of audio data and a second section that includes metadata extracted from the prerecorded spatial audio. The generated audio codec may be received by the computing device that includes an encoder. The encoder may process the generated audio codec to provide audio data that includes the metadata.

In general, the techniques disclosed herein provide a media frame that includes audio data and related metadata. The media frame may include two sections that are separated. A first of the two sections may include raw audio data, such as pulse code modulation (PCM) audio data. A second of the two sections may include metadata that is associated with the raw audio data carried in the first of the two sections. There may be a plurality of media frames. Each of the media frames may be associated with an audio channel of a downstream channel-based audio system. In some implementations, there are 16 media frames and each of the 16 media frames includes a first section of raw audio data and a second section that comprises metadata associated with the raw audio data contained in the first section. In other implementations, there are a plurality of media frames, and each of the plurality of media frames includes the described first section and second section.

In some implementations, the metadata included in the second section may have been extracted from the raw audio data that is to be disposed in the first section. Specifically, in some implementations, a decoder may receive a spatial audio stream from a provider of streaming video and associated audio. The streaming video and associated audio may be prerecorded media content. For example, a provider, such as Netflix, Hulu, Showtime, or HBO Now, may stream prerecorded spatial audio and related video media to the decoder. The decoder may process the spatial audio stream to generate the plurality of media frames by extracting metadata components or objects from the spatial audio stream, and the decoder may associate the extracted metadata components in the second section of a codec frame. Raw audio data remains after the extraction of the metadata components. The raw audio data is associated with the first section of the codec frame. In some implementations, the second section of the codec frame precedes the first section of the codec frame. In other implementations, the first section of the codec frame precedes the second section of the codec frame.

Various advantages are realized using a codec frame that comprises a first section of audio data and the second section of metadata that was extracted from the audio data contained in the first section. For example, the codec frame according to the described implementations eliminates having to use a separate codec frame that comprises metadata that is linked to separate codec frames that include only audio data. Therefore, the described apparatuses and methods do not require a separate channel for carrying a codec frame with only metadata contained therein. The separate channel may be eliminated, or the separate channel may be used for other payload for delivery to a multimedia entertainment system. A further advantage of the described apparatuses and methods that provide a codec frame that includes audio data and linked metadata is that an encoder associated with a multimedia entertainment system consumes less computational resources processing the described codec frames with segmented audio and metadata compared to the computational resources required to extract metadata from a dedicated codec frame and then reassociate the extracted metadata with disparate codec frames including only audio data.

It should be appreciated that the above-described subject matter may be implemented using or as a computer-controlled apparatus, a computer process, a computing system, or as an article of manufacture such as a computer-readable medium. These and various other features will be apparent from a reading of the following Detailed Description and a review of the associated drawings. This Summary is provided to introduce a selection of concepts in a simplified form that are further described below in the Detailed Description.

This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicates similar or identical items.

DETAILED DESCRIPTION

Figure 1:
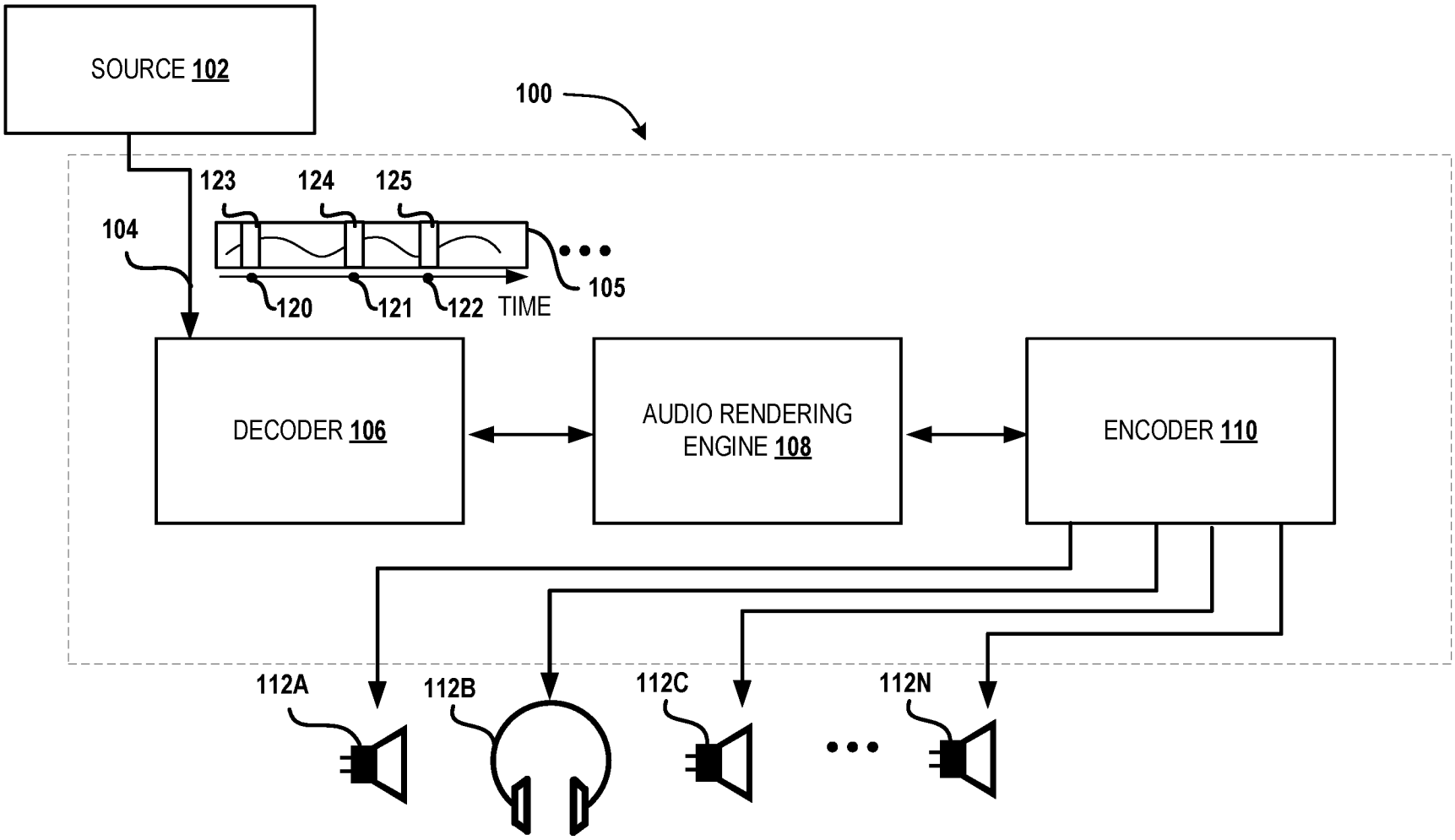
FIG. 1 is a schematic block diagram of an exemplary digital audio system that incorporates and/or implements various aspects of the disclosed exemplary implementations.

The techniques disclosed herein provide apparatuses and related methods for the communication of spatial audio and related metadata. In some implementations, a source provides prerecorded spatial audio that has embedded metadata. A computing device processes the prerecorded spatial audio to generate an audio codec that is segmented to include a first section of audio data and a second section that includes metadata extracted from the prerecorded spatial audio. The generated audio codec may be received by an endpoint device that includes an encoder. The encoder may process the generated audio codec to provide audio data that includes the metadata.

In general, the techniques disclosed herein provide a media frame that includes audio data and related metadata. The media frame may include two sections that are separated. A first of the two sections may include raw audio data, such as pulse code modulation (PCM) audio data. A second of the two sections may include metadata that is associated with the raw audio data carried in the first of the two sections. There may be a plurality of media frames. Each of the media frames may be associated with an audio channel of a downstream channel-based audio system. In some implementations, there are 16 media frames and each of the 16 media frames includes a first section of raw audio data and a second section that comprises metadata associated with the raw audio data contained in the first section. In other implementations, there are a plurality of media frames, and each of the plurality of media frames includes the described first section and second section.

In some implementations, the metadata included in the second section may have been extracted from the raw audio data that is to be disposed in the first section. Specifically, in some implementations, a decoder may receive a spatial audio stream from a provider of streaming video and associated audio. The streaming video and associated audio may be prerecorded media content. For example, a provider, such as Netflix, Hulu, Showtime, or HBO Now, may stream prerecorded spatial audio and related video media to the decoder. The decoder may process the spatial audio stream to generate the plurality of media frames by extracting metadata components or objects from the spatial audio stream, and the decoder may associate the extracted metadata components in the second section of a codec frame. Raw audio data remains after the extraction of the metadata components. The raw audio data is associated with the first section of the codec frame. In some implementations, the second section of the codec frame precedes the first section of the codec frame. In other implementations, the first section of the codec frame precedes the second section of the codec frame.

Various advantages are realized using a codec frame that comprises a first section of audio data and the second section of metadata that was extracted from the audio data contained in the first section. For example, the codec frame according to the described implementations eliminates having to use a separate codec frame that comprises metadata that is linked to separate codec frames that include only audio data. Therefore, the described apparatuses and methods do not require a separate channel for carrying a codec frame with only metadata contained therein. The separate channel may be eliminated, or the separate channel may be used for other payload for delivery to a multimedia entertainment system. A further advantage of the described apparatuses and methods that provide a codec frame that includes audio data and linked metadata is that an encoder associated with a multimedia entertainment system consumes less computational resources processing the described codec frames with segmented audio and metadata compared to the computational resources required to extract metadata from a dedicated codec frame and then reassociate the extracted metadata with disparate codec frames including only audio data.

It should be appreciated that the above-described subject matter may be implemented by or as a computer-controlled apparatus, a computer process, a computing system, or as an article of manufacture such as a computer-readable storage medium. Among many other benefits, the techniques herein improve efficiencies with respect to a wide range of computing resources. For instance, human interaction with a device may be improved as the use of the techniques disclosed herein enable a user to hear audio generated audio signals as they are intended. In addition, improved human interaction improves other computing resources such as processor and network resources. Other technical effects other than those mentioned herein can also be realized from implementations of the technologies disclosed herein. In some implementations, the functionalities and general operation of computing resources, such as processor and network resources disclosed herein, are improved by way of the disclosed codec frame structure that includes audio data separated from metadata associated with audio data. For example, the disclosed codec frame structure eliminates having to use a dedicated frame structure that carries metadata or pointers to metadata associated with disparate codec frames that include only audio data. The elimination of the dedicated frame structure that carries metadata or pointers to metadata reduces the computational overhead of an encoder associated with a multimedia system for generating audio for consumption by one or more users.

While the subject matter described herein is presented in the general context of program modules that execute in conjunction with the execution of an operating system and application programs on a computer system, those skilled in the art will recognize that other implementations may be performed in combination with other types of program modules. Generally, program modules include routines, programs, components, data structures, and other types of structures that perform particular tasks or implement particular abstract data types. Moreover, those skilled in the art will appreciate that the subject matter described herein may be practiced with other computer system configurations, including hand-held devices, multiprocessor systems, microprocessor-based or programmable consumer electronics, minicomputers, mainframe computers, and the like.

Furthermore, in the detailed description, references are made to the accompanying drawings that form a part hereof, and in which are shown by way of illustration specific configurations or examples. Referring now to the drawings, in which like numerals represent like elements throughout the several figures, aspects of a computing system, computer-readable storage medium, and computer-implemented methodologies for enabling adaptive audio rendering. As will be described in more detail below with respect to FIG. 5, there are a number of applications and modules that can embody the functionality and techniques described herein.

FIG. 1 is a schematic block diagram of an exemplary digital audio system 100 that incorporates and/or implements various aspects of the disclosed exemplary implementations. Although not described in detail herein, it is to be understood that the system 100 may, in addition to processing audio data, process video data. The dashed line box illustrated in FIG. 1 shows that various components may be linked to a single computing device. However, it is also contemplated that the various components illustrated in FIG. 1 may be individually and/or collectively linked to multiple computing devices, such as one or more servers, cloud computing devices/servers, and the like. The system 100 illustrated in FIG. 1 may comprise some or all of the components illustrated in FIG. 5.

A source 102 may provide streaming audio data 104 to the system 100. The streaming audio data 104 may also include associated video data. In some implementations, the source 102 may be an Internet-based video and audio streaming service, such as Netflix, Hulu, and HBO Now. In other implementations, the source 102 may also be a media streaming device, such as a Blu-ray device and/or DVD player.

In some implementations, the source 102 provides, as part of the streaming audio data 104, streaming spatial audio content 105 to the system 100. The streaming spatial audio content provided by the source 102 may include audio data that is embedded with one or more metadata components 123-125 offset at time positions 120-122. In some implementations, the audio data is pulse code modulated (PCM) data combined with metadata components 123-125. For example, one of the metadata components 123-125 embedded in the audio data may include positional metadata including one or more coordinates to render the audio data in a three-dimensional space.

In addition to positional metadata, other metadata components may be included in the streaming spatial audio content 105 provided by the source 102. For example, the streaming spatial audio content may include metadata components 123-125 defining a gain of the at least a portion of audio data and/or calibration information for one or more audio rendering elements (e.g., speakers) to playback the at least a portion of the audio data. Additionally, the metadata components 123-125 included in the streaming spatial audio content 105 provided by the source 102 may specify speaker mask parameters that indicate one or more speakers to render at least a portion of the audio data associated with the streaming spatial audio content 105 provided by the source 102.

The streaming spatial audio content 105 provided by the source 102 may be received by a decoder 106 of the system 100. The decoder 106 is functional to process the streaming spatial audio content 105 provided by the source 102. Therefore, the decoder 106 may comprise storage to store streaming audio content 105 provided by the source 102. The storage may be a buffer, a plurality buffers, or any other storage suitable for storing or buffering streaming audio content, related video content, and the like.

Figure 2:
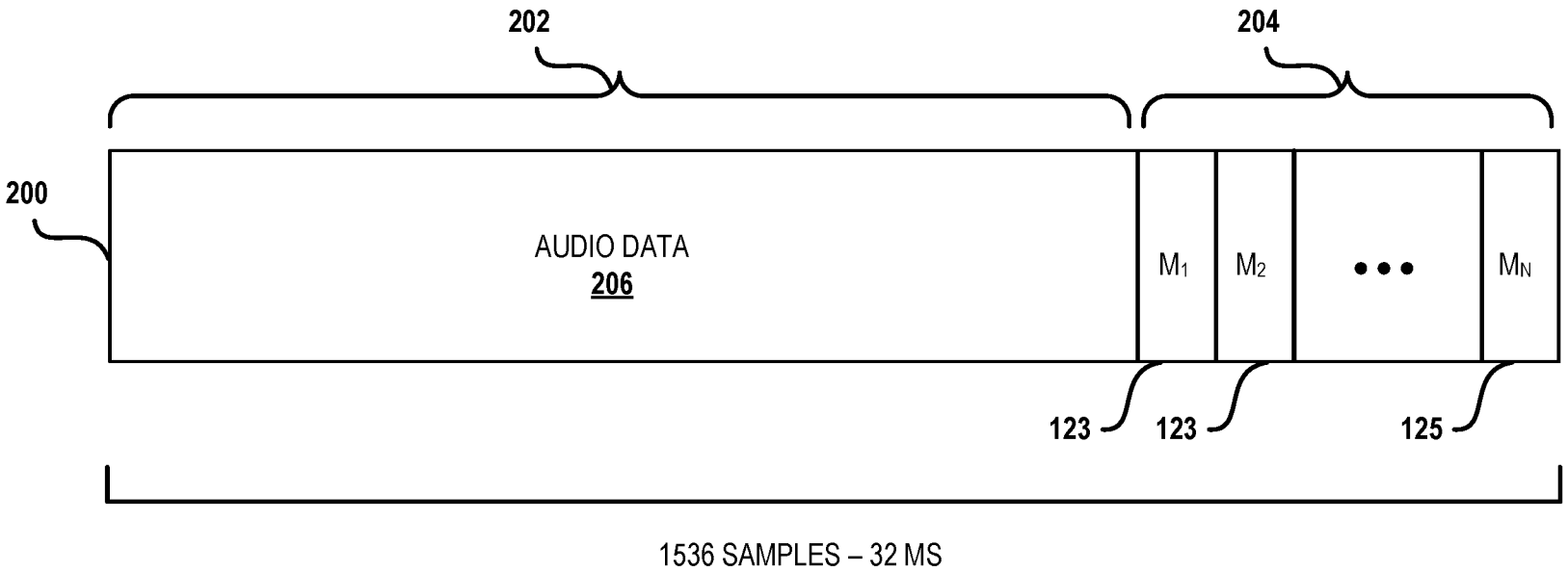
FIG. 2 illustrates a codec frame that incorporates and/or implements various aspects of the disclosed exemplary implementations.

In some implementations, the decoder 106 processes the streaming spatial audio content 105 to provide a plurality of codec frames. In particular implementations, the decoder 106 processes the streaming spatial audio content 105 to provide 16 codec frames, where each of the 16 codec frames includes a plurality of separated sections. For example, the decoder 106 may provide a plurality of codec frames, where each of the plurality of codec frames includes a first section including audio data from the streaming spatial audio content 105 and a second section including one or more metadata components 123-125 extracted from the audio data. An exemplary codec frame that includes a plurality of separated sections is illustrated in FIG. 2.

The plurality of codec frames generated by the decoder 106 may be communicated to an audio rendering engine 108. In some implementations, the decoder 106 communicates 16 codec frames to the audio rendering engine 108. Each of the communicated 16 codec frames may include first and second separated sections. The first section may include audio data and the second section may include one or more metadata components 123-125 extracted from the streaming spatial audio content provided by the source 102.

In some implementations, the second section may include one or more metadata components 123-125 extracted from the audio data comprised in the first section.

The audio rendering engine 108 may advertise a metadata format identification. Similarly, the decoder 106 may advertise the metadata format identification. From the decoder 106 end, the metadata format identification serves to indicate that the decoder 106 generates codec frames that include a first section comprising audio data and a second section comprising one or more metadata components 123-125. From the audio rendering engine 108 end, advertising the metadata format identification serves to indicate that an encoder 110 can process codec frames that include a first section comprising audio data and a second section comprising metadata 123-125. In some implementations, the audio rendering engine 108 communicates an acknowledgment to the decoder 106 that the encoder 110 can process codec frames that include a first section comprising audio data and a second section comprising one or more metadata components 123-125. The acknowledgment from the audio rendering engine 108 may be communicated to the decoder 106 in response to the metadata format identification advertised by the decoder 106.

The audio rendering engine 108 may communicate a plurality of the codec frames to the encoder 110. The encoder 110 processes the plurality of codec frames from the audio rendering engine 108 to provide channel-based audio to a suitable number (N) of output devices 112. For illustrative purposes, some example output devices 112 are individually referred to herein as a first output device 112A, a second output device 112B, and a third output device 112C. Examples of an output device 112, also referred to herein as an "endpoint device," include, but are not limited to, speaker systems and headphones. The encoder 110 and/or an output device 112 can be configured to utilize one or more spatialization technologies such as Dolby Atmos, HRTF, etc.

The provided channel-based audio may include individual channels that are associated with audio objects. For instance, a Dolby 5.1, 7.1 or 9.1 signal may include multiple channels of audio and each channel can be associated with one or more positions. Metadata components can define one or more positions associated with individual channels of a channel-based audio signal. Furthermore, the channel-based audio can include any form of object-based audio. In general, object-based audio defines objects that are associated with audio data. For instance, in a movie, a gunshot can be one object and a person's scream can be another object. Each object can also have an associated position. Metadata components of the object-based audio enable applications and systems, in some implementations, to specify where each sound object originates and how they should move.

In some implementations, each of the plurality of codec frames received by the encoder 110 includes a first section of audio data and a second section of one or more metadata components 123-125. The encoder 110 is configured to process the plurality of codec frames to provide a rendered audio stream comprising channel-based audio and object-based audio according to one or more spatialization technologies. A rendered stream generated by an encoder 110 can be communicated to the one or more output devices 105.

The encoders 110 can also implement other functionality, such as one or more echo cancellation technologies. Such technologies are beneficial to select and utilize outside of the application environment, as individual applications do not have any context of other applications, and thus are unable to determine when echo cancelation and other like technologies should be utilized.

FIG. 2 illustrates a codec frame 200. The codec frame 200 may be one of the plurality of codec frames generated by the decoder 106. The codec frame 200 may include a first section 202 and a second section 204. The first section 202 may include audio data 206. The audio data 206 may be PCM audio data. In some implementations, the audio data 206 is derived from streaming audio data 104 provided by the source 102. Specifically, in some implementations, the audio data 206 is generated by the decoder 106. In some implementations, the decoder 106 generates the audio data 206 by removing one or more metadata components 123-125 from a portion of the spatial streaming audio content 105 provided by the source 102.

In some implementations, the codec frame 200 comprises 1536 samples and consumes a time duration of the 32 ms. In other implementations, the first section 202 comprises 1536 samples and consumes a time duration of 32 ms. The second section 204 may comprise additional samples and may consume an additional time duration. The additional samples and the additional time duration of the second section 204 may be directly related to a number of metadata components associated with the second section 204.

The second section 204 may include one or more metadata components $M_1$-$M_N$, where N is an integer. In some implementations, the second section 204 includes the one or more metadata components 123-125. In some implementations, the metadata components 210-214 comprise positional metadata 123 including one or more coordinates (X,Y,Z) to render the at least a portion of the audio data 206 in a three-dimensional space, a gain 124 of the at least a portion of audio data 206, and calibration information 125 for one or more audio rendering elements (e.g., one or more output devices 112) to playback the at least a portion of the audio data 206. In some implementations, the one or more metadata components $M_1$-$M_N$ are pointers to memory or buffer locations in the decoder 106 that are designated to store metadata components 123-125.

Figure 3:
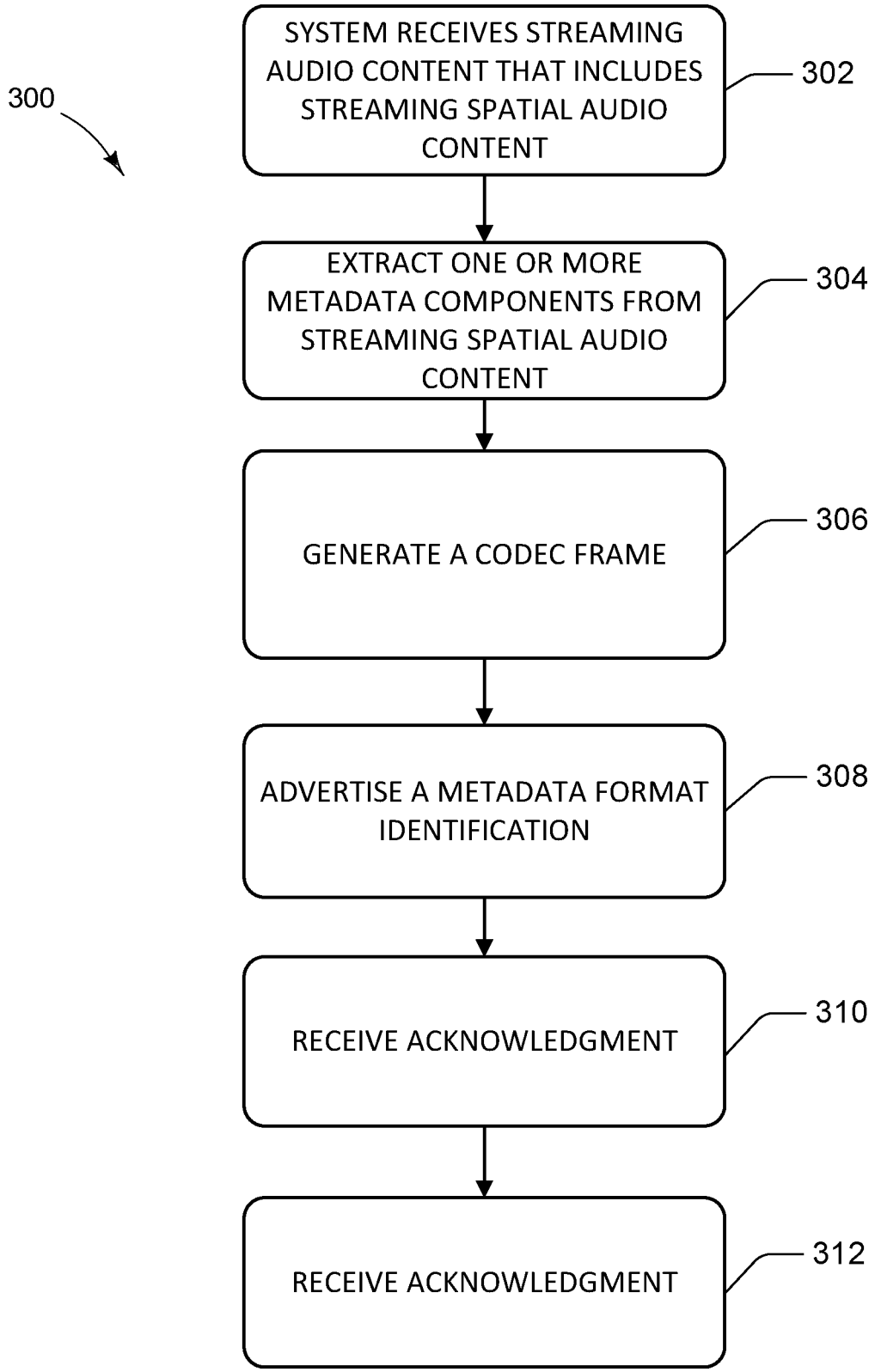
FIG. 3 illustrates aspects of a routine for generating one or more codec frames according to one or more described exemplary implementations.

Turning now to FIG. 3, aspects of a routine 300 for generating one or more codec frames are shown and described. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims.

It also should be understood that the illustrated methods can end at any time and need not be performed in its entirety. Some or all operations of the methods, and/or substantially equivalent operations, can be performed by execution of computer-readable instructions included on a computer-storage media, as defined below. The term "computer-readable instructions," and variants thereof, as used in the description and claims, is used expansively herein to include routines, applications, application modules, program modules, programs, components, data structures, algorithms, and the like. Computer-readable instructions can be implemented on various system configurations, including single-processor or multiprocessor systems, minicomputers, mainframe computers, personal computers, hand-held computing devices, microprocessor-based, programmable consumer electronics, combinations thereof, and the like.

Thus, it should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as states, operations, structural devices, acts, or modules. These operations, structural devices, acts, and modules may be implemented in software, in firmware, in special purpose digital logic, and any combination thereof.

For example, the operations of the routine 300 are described herein as being implemented, at least in part, by an application, component and/or circuit, such as the system 100 and/or the decoder 106. In some configurations, the system 100 and/or the decoder 106 can be a dynamically linked library (DLL), a statically linked library, functionality produced by an application programming interface (API), a compiled program, an interpreted program, a script or any other executable set of instructions. Data and/or modules generated by or associated with the system 100 may be stored in a data structure in one or more memory components. Data can be retrieved from the data structure by addressing links or references to the data structure.

Although the following illustration refers to the components and elements illustrated in the figures and described herein, it can be appreciated that the operations of the routine 300 may be also implemented in many other ways. For example, the routine 300 may be implemented, at least in part, by a processor of another remote computer or a local circuit. In addition, one or more of the operations of the routine 300 may alternatively or additionally be implemented, at least in part, by a chipset working alone or in conjunction with other software modules. Any service, circuit or application suitable for providing the techniques disclosed herein can be used in operations described herein.

With reference to FIG. 3, the routine 300 begins at operation 302, where the system 100 receives streaming audio content 104, which may include streaming spatial audio content 105, from the source 102. In some implementations, the streaming audio content 104 is received by the decoder 106. The streaming audio content 104 may also include associative video data. In some implementations, the source 102 may be an Internet-based video and audio streaming service, such as Netflix, Hulu, and HBO Now. In other implementations, the source 102 may also be a media streaming device, such as a Blu-ray device and/or DVD player.

In some implementations, the source 102 provides, as part of the streaming audio data 104, streaming spatial audio content 105 to the system 100. The streaming spatial audio content 105 provided by the source 102 may include audio data that is embedded with one or more metadata components 123-125. In some implementations, the audio data is pulse code modulated (PCM) data combined with metadata components 123-125. For example, one of the metadata components 123-125 embedded in the audio data may include positional metadata including one or more coordinates to render the audio data in a three-dimensional space. In addition to positional metadata, other metadata components may be included in the streaming spatial audio content 105 provided by the source 102. For example, the streaming spatial audio content 105 may include metadata components defining a gain of the at least a portion of audio data and/or calibration information for one or more audio rendering elements (e.g., speakers 112) to playback the at least a portion of the audio data. Additionally, the metadata components 123-125 included in the streaming spatial audio content 105 provided by the source 102 may specify speaker mask parameters that indicate one or more speakers to render at least a portion of the audio data associated with the streaming spatial audio content 105 provided by the source 102.

At operation 304, the decoder 106 extracts one or more metadata components 123-125 from the streaming audio spatial content 105. The decoder 106 may store the extracted one or more metadata components 123-125 in a storage associated with the decoder 106, such as a buffer, or more generally in a storage associated with the system 100.

At operation 306, the decoder 106 generates one or more codec frames 200. The one or more codec frames 200 may comprise a first section 202 and a second section 204. The first section 202 may include audio data 206. The audio data 206 may be PCM audio data. In some implementations, the audio data 206 is derived from streaming audio data 104 provided by the source 102. Specifically, in some implementations, the audio data 206 is generated by the decoder 106. In some implementations, the decoder 106 generates the audio data 206 by removing one or more metadata components 123-125 from a portion of the streaming audio data 104 provided by the source 102.

In some implementations, the codec frame 200 comprises 1536 samples and consumes a time duration of the 32 ms. In other implementations, the first section 202 comprises 1536 samples and consumes a time duration of 32 ms. The second section 204 may comprise additional samples and may consume an additional time duration. The additional samples and the additional time duration of the second section 204 may be directly related to a number of metadata components associated with the second section 204.

The second section 204 may include one or more metadata components $M_1$-$M_N$, where N is an integer. In some implementations, the metadata components 123-125 comprise positional metadata 123 including one or more coordinates (X,Y,Z) to render the at least a portion of the audio data 206 in a three-dimensional space, a gain 124 of the at least a portion of audio data 206, and calibration information 125 for one or more audio rendering elements (e.g., one or more output devices 112) to playback the at least a portion of the audio data 206. In some implementations, the one or more metadata components $M_1$-$M_N$ are pointers to memory or buffer locations in the decoder 106 that are designated to store metadata components 123-125. Other metadata components metadata components $M_1$-$M_N$ may be included in the second section 204. For example, the metadata components included in the second section 204 may specify speaker mask parameters that indicate one or more speakers 112 to render at least a portion of the audio data 206.

At operation 308, the decoder 106 or system 100 advertises a metadata format identification. The metadata format identification serves to indicate that the decoder 106 generates codec frames 200 that include a first section 202 comprising audio data and a second section 204 comprising one or more metadata components 123-125.

At operation 310, the decoder 106 or system 100 receives an acknowledgment that the encoder 110 can process the one or more codec frames 200.

At operation 312, the decoder 106 or the system 100 communicates the one or more codec frames 202 the encoder 110.

Figure 4:
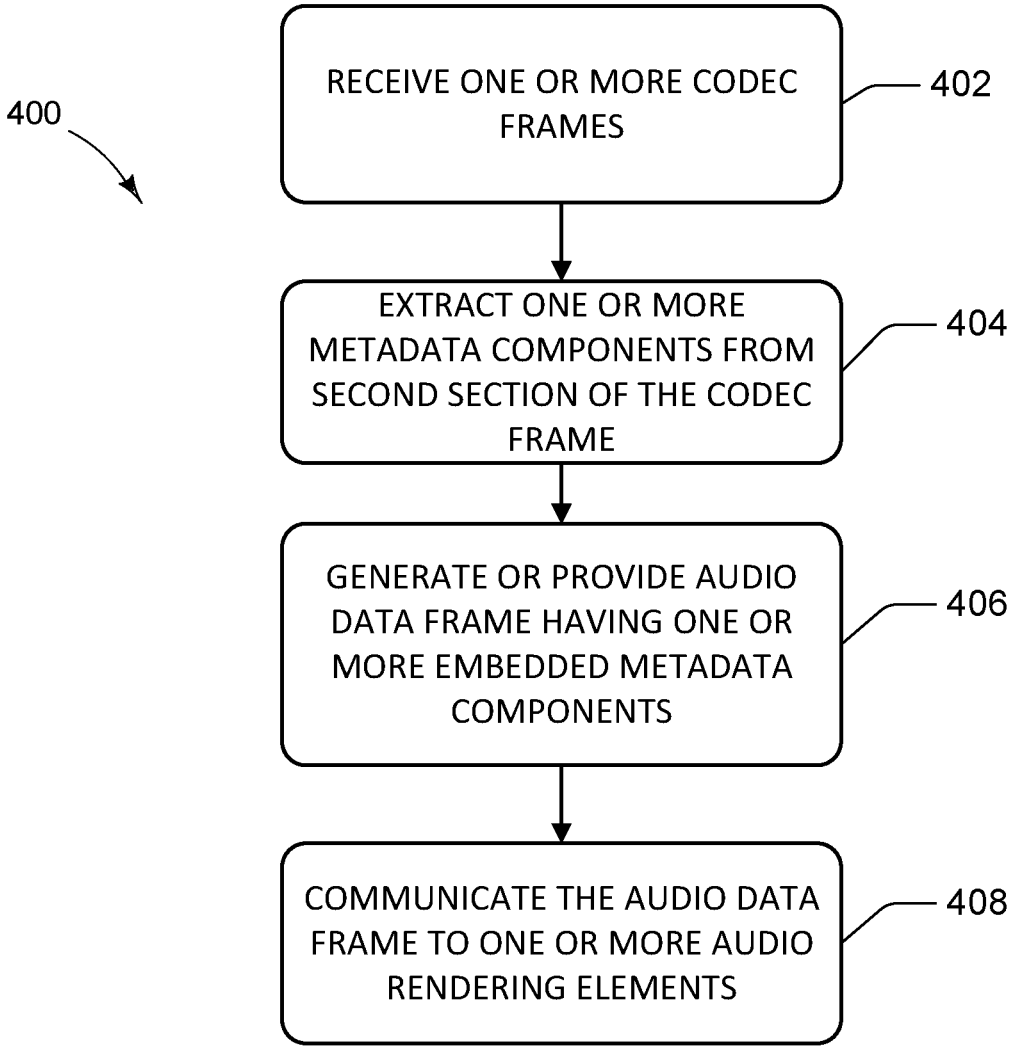
FIG. 4 illustrates aspects a routine for receiving and processing one or more codec frames are shown and described.

Turning now to FIG. 4, aspects of a routine 400 for receiving and processing one or more codec frames are shown and described. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims.

It also should be understood that the illustrated methods can end at any time and need not be performed in its entirety. Some or all operations of the methods, and/or substantially equivalent operations, can be performed by execution of computer-readable instructions included on a computer-storage media, as defined below. The term "computer-readable instructions," and variants thereof, as used in the description and claims, is used expansively herein to include routines, applications, application modules, program modules, programs, components, data structures, algorithms, and the like. Computer-readable instructions can be implemented on various system configurations, including single-processor or multiprocessor systems, minicomputers, mainframe computers, personal computers, hand-held computing devices, microprocessor-based, programmable consumer electronics, combinations thereof, and the like.

Thus, it should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as states, operations, structural devices, acts, or modules. These operations, structural devices, acts, and modules may be implemented in software, in firmware, in special purpose digital logic, and any combination thereof.

For example, the operations of the routine 400 are described herein as being implemented, at least in part, by an application, component and/or circuit, such as the system 100 and/or the encoder 110. In some configurations, the system 100 and/or the encoder 110 can be a dynamically linked library (DLL), a statically linked library, functionality produced by an application programming interface (API), a compiled program, an interpreted program, a script or any other executable set of instructions. Data and/or modules generated by or associated with the system 100 may be stored in a data structure in one or more memory components. Data can be retrieved from the data structure by addressing links or references to the data structure.

Although the following illustration refers to the components and elements illustrated in the figures and described herein, it can be appreciated that the operations of the routine 400 may be also implemented in many other ways. For example, the routine 400 may be implemented, at least in part, by a processor of another remote computer or a local circuit. In addition, one or more of the operations of the routine 400 may alternatively or additionally be implemented, at least in part, by a chipset working alone or in conjunction with other software modules. Any service, circuit or application suitable for providing the techniques disclosed herein can be used in operations described herein.

With reference to FIG. 4, the routine 400 begins at operation 402, where the system 100, in particular the encoder 110, receives one or more codec frames 200 from the decoder 106. The codec frame 200 may include a first section 202 and a second section 204. The first section 202 may include audio data 206. The audio data 206 may be PCM audio data. In some implementations, the audio data 206 is derived from streaming audio data 104, such as the spatial audio streaming content 105, provided by the source 102. Specifically, in some implementations, the audio data 206 is generated by the decoder 106.

In some implementations, at operation 402, and prior to receiving the one or more codec frames 200 from the decoder 106, the encoder 110 advertises a metadata format identification that indicates that the encoder 110 supports and is able to process the codec frame 200. Furthermore, in some implementations, at operation 402, the encoder 110 may communicate an acknowledgment to the decoder 106, where the acknowledgment confirms that the encoder 110 supports and is able to process the codec frame 200.

In some implementations, the codec frame 200 comprises 1536 samples and consumes a time duration of the 32 ms. In other implementations, the first section 202 comprises 1536 samples and consumes a time duration of 32 ms. The second section 204 may comprise additional samples and may consume an additional time duration. The additional samples and the additional time duration of the second section 204 may be directly related to a number of metadata components associated with the second section 204.

The second section 204 may include one or more metadata components $M_1$-$M_N$ 123-125 where N is an integer. In some implementations, the metadata components 123-125 comprise positional metadata 123 including one or more coordinates (X,Y,Z) to render the at least a portion of the audio data 206 in a three-dimensional space, a gain 124 of the at least a portion of audio data 206, and calibration information 125 for one or more audio rendering elements (e.g., one or more output devices 112) to playback the at least a portion of the audio data 206. In some implementations, the one or more metadata components $M_1$-$M_N$ 1 and 23-125 are pointers to memory or buffer locations in the decoder 106 that are designated to store metadata components.

Other metadata components metadata components $M_1$-$M_N$ may be included in the second section 204. For example, the metadata components included in the second section 204 may specify speaker mask parameters that indicate one or more speakers 112 to render at least a portion of the audio data 206.

At operation 404, the encoder 110 extracts one or more metadata components $M_1$-$M_N$ 123-125 from the second section 204 of the codec frame 200.

At operation 406, the encoder 110 associates the extracted one or more metadata components $M_1$-$M_N$ 123-125 with the audio data 206 disposed in the second section 204 of the codec frame 200. In some implementations, the encoder 110 associates the extracted one or more metadata components $M_1$-$M_N$ 123-125 at one or more offset positions, such as time based offset positions 120-122, between a beginning of the audio data 206 and an end of the audio data 206 disposed in the second section 204 of the codec frame 200. Therefore, at operation 406, the encoder 110 provides an audio data frame having embedded therein one or more metadata components $M_1$-$M_N$ 123-125 positioned at one or more offset positions associated with the audio data frame.

At operation 408, the encoder 110 communicates the audio data frame having embedded therein one or more metadata components $M_1$-$M_N$ 123-125 to one or more audio rendering elements (e.g., speakers 112) to playback at least a portion of the audio data 106.

Figure 5:
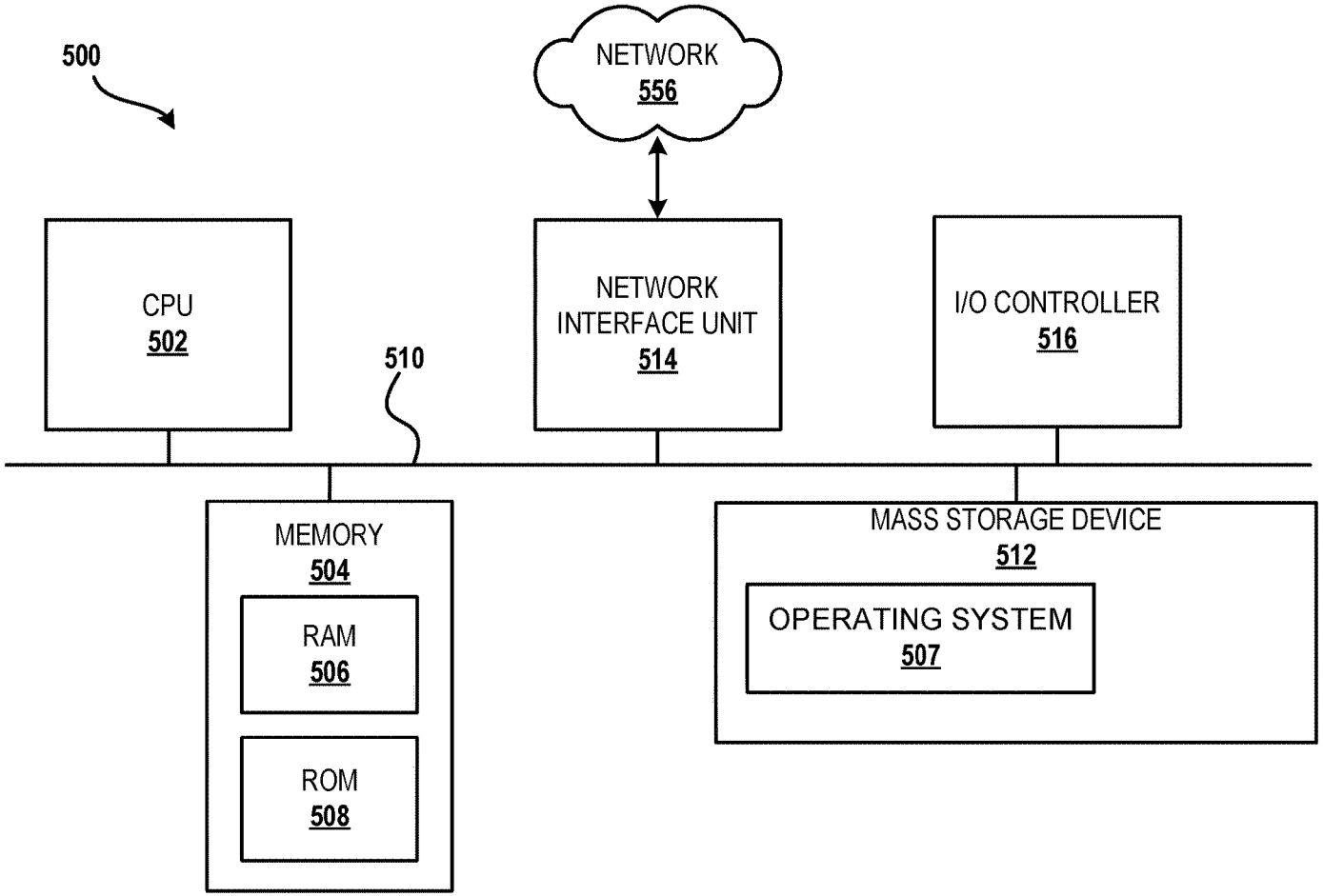
FIG. 5 is a computer architecture diagram illustrating an illustrative computer hardware and software architecture for a computing system capable of implementing aspects of the techniques and technologies presented herein.

FIG. 5 shows additional details of an example computer architecture 500 for a computer, such as the computer related components illustrated in FIG. 1, capable of executing the program components described herein. Thus, the computer architecture 500 illustrated in FIG. 5 illustrates an architecture for a server computer, mobile phone, a PDA, a smart phone, a desktop computer, a netbook computer, a tablet computer, and/or a laptop computer. The computer architecture 500 may be utilized to execute any aspects of the software components presented herein.

The computer architecture 500 illustrated in FIG. 5 includes a central processing unit 502 ("CPU"), a system memory 504, including a random access memory 506 ("RAM") and a read-only memory ("ROM") 508, and a system bus 510 that couples the memory 504 to the CPU 502. A basic input/output system containing the basic routines that help to transfer information between elements within the computer architecture 500, such as during startup, is stored in the ROM 508. The computer architecture 500 further includes a mass storage device 512 for storing an operating system 507, one or more applications, the streaming audio 104, codec frames 200, and other data and/or modules.

The mass storage device 512 is connected to the CPU 502 through a mass storage controller (not shown) connected to the bus 510. The mass storage device 512 and its associated computer-readable media provide non-volatile storage for the computer architecture 500. Although the description of computer-readable media contained herein refers to a mass storage device, such as a solid state drive, a hard disk or CD-ROM drive, it should be appreciated by those skilled in the art that computer-readable media can be any available computer storage media or communication media that can be accessed by the computer architecture 500.

Communication media includes computer readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

By way of example, and not limitation, computer storage media may include volatile and non-volatile, removable and non-removable media implemented in any method or technology for storage of information such as computer-readable instructions, data structures, program modules or other data. For example, computer media includes, but is not limited to, RAM, ROM, EPROM, EEPROM, flash memory or other solid state memory technology, CD-ROM, digital versatile disks ("DVD"), HD-DVD, BLU-RAY, or other optical storage, magnetic cassettes, magnetic tape, magnetic disk storage or other magnetic storage devices, or any other medium which can be used to store the desired information and which can be accessed by the computer architecture 500. For purposes the claims, the phrase "computer storage medium," "computer-readable storage medium" and variations thereof, does not include waves, signals, and/or other transitory and/or intangible communication media, per se.

According to various configurations, the computer architecture 500 may operate in a networked environment using logical connections to remote computers through the network 556 and/or another network (not shown). The computer architecture 500 may connect to the network 556 through a network interface unit 514 connected to the bus 510. It should be appreciated that the network interface unit 514 also may be utilized to connect to other types of networks and remote computer systems. The computer architecture 500 also may include an input/output controller 516 for receiving and processing input from a number of other devices, including a keyboard, mouse, or electronic stylus (not shown in FIG. 5). Similarly, the input/output controller 516 may provide output to a display screen, a printer, or other type of output device (also not shown in FIG. 5).

It should be appreciated that the software components described herein may, when loaded into the CPU 502 and executed, transform the CPU 502 and the overall computer architecture 500 from a general-purpose computing system into a special-purpose computing system customized to facilitate the functionality presented herein. The CPU 502 may be constructed from any number of transistors or other discrete circuit elements, which may individually or collectively assume any number of states. More specifically, the CPU 502 may operate as a finite-state machine, in response to executable instructions contained within the software modules disclosed herein. These computer-executable instructions may transform the CPU 502 by specifying how the CPU 502 transitions between states, thereby transforming the transistors or other discrete hardware elements constituting the CPU 502.

Encoding the software modules presented herein also may transform the physical structure of the computer-readable media presented herein. The specific transformation of physical structure may depend on various factors, in different implementations of this description. Examples of such factors may include, but are not limited to, the technology used to implement the computer-readable media, whether the computer-readable media is characterized as primary or secondary storage, and the like. For example, if the computer-readable media is implemented as semiconductor-based memory, the software disclosed herein may be encoded on the computer-readable media by transforming the physical state of the semiconductor memory. For example, the software may transform the state of transistors, capacitors, or other discrete circuit elements constituting the semiconductor memory. The software also may transform the physical state of such components in order to store data thereupon.

As another example, the computer-readable media disclosed herein may be implemented using magnetic or optical technology. In such implementations, the software presented herein may transform the physical state of magnetic or optical media, when the software is encoded therein. These transformations may include altering the magnetic characteristics of particular locations within given magnetic media. These transformations also may include altering the physical features or characteristics of particular locations within given optical media, to change the optical characteristics of those locations. Other transformations of physical media are possible without departing from the scope and spirit of the present description, with the foregoing examples provided only to facilitate this discussion.

In light of the above, it should be appreciated that many types of physical transformations take place in the computer architecture 500 in order to store and execute the software components presented herein. It also should be appreciated that the computer architecture 500 may include other types of computing devices, including hand-held computers, embedded computer systems, personal digital assistants, and other types of computing devices known to those skilled in the art. It is also contemplated that the computer architecture 500 may not include all of the components shown in FIG. 5, may include other components that are not explicitly shown in FIG. 5, or may utilize an architecture completely different than that shown in FIG. 5.

The disclosure presented herein may be considered in view of the following examples.

Example 1

A computing device, comprising: a processor; a computer-readable storage medium in communication with the processor, the computer-readable storage medium having computer-executable instructions stored thereupon which, when executed by the processor, cause the processor to: receive a spatial audio stream, the spatial audio stream including audio data and at least one associated metadata component, the at least one associated metadata component comprising positional metadata used to render at least a portion of the audio data in a three-dimensional space; extract the at least one associated metadata component from the spatial audio stream; store the at least one associated metadata component in a storage associated with the computing device; and generate a codec frame having a predetermined length and comprising first and second separated sections, the first section including at least a portion of the audio data and the second section including the at least one associated metadata component extracted from the spatial audio stream.

Example 2

The computing device according to example 1, wherein the spatial audio stream includes the audio data and a plurality of associated metadata components, the processor to extract the plurality of associated metadata components, store the plurality of associated metadata components, and generate the codec frame including the plurality of associated metadata components disposed in the second section of the codec frame.

Example 3

The computing device according to example 2, wherein the plurality of associated metadata components comprises the positional metadata including one or more coordinates to render the at least a portion of the audio data in the three-dimensional space, a gain of the at least a portion of audio data, and calibration information for one or more audio rendering elements to playback the at least a portion of the audio data.

Example 4

The computing device according to examples 1, 2 and 3, wherein the audio data is pulse code modulation (PCM) audio data and the predetermined length is 32 ms and comprises 1536 PCM samples.

Example 5

The computing device according to examples 1, 2, 3 and 4, wherein the computer-executable instructions, when executed by the processor, cause the processor to advertise a metadata format identification indicating that the computing device is to generate the codec frame having the predetermined length and comprising the first and second separated sections.

Example 6

The computing device according to example 5, wherein the computer-executable instructions, when executed by the processor, cause the computing device to receive an acknowledgment that an encoder associated with an endpoint device supports the codec frame having the predetermined length and comprising the first and second separated sections.

Example 7

The computing device according to example 6, wherein the acknowledgment is received in response to the metadata format identification advertised by the computing device.

Example 8

The computing device according to example 5, wherein the computer-executable instructions, when executed by the processor, cause the processor to extract the at least one associated metadata component from the at least a portion of the audio data, and generate the codec frame having the predetermined length and comprising the first and second separate sections, the first section including the at least a portion of the audio data and the second section including the at least one associated metadata component extracted from the at least a portion of audio data.

Example 9

The computing device according to claim 1, wherein the spatial audio stream is associated with prerecorded media provided by a streaming service provider that provides streaming media content to endpoint devices and users of the endpoint devices.

Example 10

A computing device, comprising: a processor; a computer-readable storage medium in communication with the processor, the computer-readable storage medium having computer-executable instructions stored thereupon which, when executed by the processor, cause the processor to: receive a codec frame having a predetermined length and comprising first and second separated sections, the first section including at least a portion of audio data from a prerecorded spatial audio stream and a second section including at least one metadata component extracted from the audio data; extract the at least one metadata component from the second section; associate the at least one metadata component at an offset position between a beginning of the at least a portion of audio data comprised in the first section and an end of the at least the portion of the audio data comprised in the first section to provide an audio data frame having the at least one metadata component embedded therein at the offset position; generate an audio stream comprising at least at the audio data frame; and communicate the audio stream to one or more audio rendering elements to playback the at least a portion of the audio data.

Example 11

The computing device according to example 10, wherein the second section includes a plurality of metadata components extracted from the audio data, each of the plurality of metadata components disposed in a segmented section of the second section.

Example 12

The computing device according to example 11, wherein the plurality of associated metadata components comprises positional metadata including one or more coordinates to render the at least a portion of the audio data in a three-dimensional space, a gain of the at least a portion of audio data, and calibration information for the one or more audio rendering elements to playback the at least a portion of the audio data.

Example 13

The computing device according to examples 11 and 12, wherein the audio data is pulse code modulation (PCM) audio data and the predetermined length is 32 ms and comprises 1536 PCM samples.

Example 14

The computing device according to examples 11, 12 and 13, wherein the computer-executable instructions, when executed by the processor, cause the computing device to advertise a metadata format identification indicating that the computing device supports the codec frame having the predetermined length and comprising the first and second separated sections.

Example 15

The computing device according to example 14, wherein the computer-executable instructions, when executed by the processor, cause the computing device to communicate an acknowledgment that the computing device supports the codec frame having the predetermined length and comprising the first and second separated sections.

Example 16

The computing device according to example 15, wherein the acknowledgment is communicated in response to the metadata format identification advertised by the processor.

Example 17

The computing device according to examples 11-16, wherein the spatial audio stream is associated with prerecorded media provided by a streaming service provider that provides streaming media content to endpoint devices and users of the endpoint devices.

Example 18

A computing device, comprising: a processor; a computer-readable storage medium in communication with the processor, the computer-readable storage medium having computer-executable instructions stored thereupon which, when executed by the processor, cause the processor to: receive a prerecorded spatial audio stream, the prerecorded spatial audio stream including audio data and a plurality of associated metadata components, at least one of the plurality of metadata components comprising positional metadata used to render at least a portion of the audio data in a three-dimensional space; extract the plurality of associated metadata components from the spatial audio stream; and generate a codec frame having a predetermined length and comprising first and second separated sections, the first section including at least a portion of the audio data and the second section including the plurality of associated metadata components extracted from the spatial audio stream.

Example 19

The computing device according to example 18, wherein the computer-executable instructions, when executed by the processor, cause the processor to generate the codec frame with the second section having a plurality of segmented segments, each of the plurality of segmented segments containing one of the plurality of associated metadata components.

Example 20

The computing device according to examples 18 and 19, wherein the plurality of associated metadata components comprises the positional metadata including one or more coordinates to render the at least a portion of the audio data in the three-dimensional space, a gain of the at least a portion of audio data, and calibration information for one or more audio rendering elements to playback the at least a portion of the audio data.

In closing, although the various configurations have been described in language specific to structural features and/or methodological acts, it is to be understood that the subject matter defined in the appended representations is not necessarily limited to the specific features or acts described. Rather, the specific features and acts are disclosed as example forms of implementing the claimed subject matter.

What is claimed is:

1. A computing device, comprising:

a processor;

a computer-readable storage medium in communication with the processor, the computer-readable storage medium having computer-executable instructions stored thereupon which, when executed by the processor, cause the processor to:

receive a codec frame having a predetermined length and comprising first and second separated sections, the first section including at least a portion of audio data from a prerecorded spatial audio stream and a second section including at least one metadata component extracted from the audio data;

extract the at least one metadata component from the second section;

associate the at least one metadata component at an offset position between a beginning of the at least a portion of audio data comprised in the first section and an end of the at least the portion of the audio data comprised in the first section to provide an audio data frame having the at least one metadata component embedded therein at the offset position;

generate an audio stream comprising at least the audio data frame; and communicate the audio stream to one or more audio rendering elements to playback the at least a portion of the audio data.

2. The computing device according to claim 1, wherein the second section includes a plurality of metadata components extracted from the audio data, each of the plurality of metadata components disposed in a segmented section of the second section.

3. The computing device according to claim 2, wherein the plurality of associated metadata components comprises positional metadata including one or more coordinates to render the at least a portion of the audio data in a three-dimensional space, a gain of the at least a portion of audio data, and calibration information for the one or more audio rendering elements to playback the at least a portion of the audio data.

4. The computing device according to claim 1, wherein the audio data is pulse code modulation (PCM) audio data and the predetermined length is 32 ms and comprises 1536 PCM samples.

5. The computing device according to claim 1, wherein the computer-executable instructions, when executed by the processor, cause the computing device to advertise a metadata format identification indicating that the computing device supports the codec frame having the predetermined length and comprising the first and second separated sections.

6. The computing device according to claim 5, wherein the computer-executable instructions, when executed by the processor, cause the computing device to communicate an acknowledgment that the computing device supports the codec frame having the predetermined length and comprising the first and second separated sections.

7. The computing device according to claim 6, wherein the acknowledgment is communicated in response to the metadata format identification advertised by the processor.

8. The computing device according to claim 1, wherein the spatial audio stream is associated with prerecorded media provided by a streaming service provider that provides streaming media content to endpoint devices and users of the endpoint devices.

9. A computing device, comprising:

a processor;

a computer-readable storage medium in communication with the processor, the computer-readable storage medium having computer-executable instructions stored thereupon which, when executed by the processor, cause the processor to:

receive a codec frame having a predetermined length and comprising first and second separated sections, the first section including at least a portion of audio data from a spatial audio stream and a second section including at least one metadata component extracted from the audio data;

extract the at least one metadata component from the second section;

associate the at least one metadata component at a time based offset position between a beginning of the at least a portion of audio data comprised in the first section and an end of the at least the portion of the audio data comprised in the first section to provide an audio data frame having the at least one metadata component embedded therein at the time based offset position;

generate an audio stream comprising at least the audio data frame; and communicate the audio stream to one or more audio rendering elements to playback the at least a portion of the audio data.

10. The computing device according to claim 9, wherein the second section includes a plurality of metadata components extracted from the audio data, each of the plurality of metadata components disposed in a segmented section of the second section.

11. The computing device according to claim 10, wherein the plurality of associated metadata components comprises positional metadata including one or more coordinates to render the at least a portion of the audio data in a three-dimensional space, a gain of the at least a portion of audio data, and calibration information for the one or more audio rendering elements to playback the at least a portion of the audio data.

12. The computing device according to claim 9, wherein the audio data is pulse code modulation (PCM) audio data and the predetermined length is 32 ms and comprises 1536 PCM samples.

13. The computing device according to claim 9, wherein the computer-executable instructions, when executed by the processor, cause the computing device to advertise a metadata format identification indicating that the computing device supports the codec frame having the predetermined length and comprising the first and second separated sections.

14. The computing device according to claim 13, wherein the computer-executable instructions, when executed by the processor, cause the computing device to communicate an acknowledgment that the computing device supports the codec frame having the predetermined length and comprising the first and second separated sections.

15. The computing device according to claim 14, wherein the acknowledgment is communicated in response to the metadata format identification advertised by the processor.

16. The computing device according to claim 9, wherein the spatial audio stream is associated with prerecorded media provided by a streaming service provider that provides streaming media content to endpoint devices and users of the endpoint devices.

17. A computer implemented method, the method comprising:

receiving a codec frame having a predetermined length and comprising first and second sections, the first section including at least a portion of audio data from a spatial audio stream and a second section including at least one metadata component extracted from the audio data;

extracting the at least one metadata component from the second section;

associating the at least one metadata component at an offset position between a beginning of the at least a portion of audio data comprised in the first section and an end of the at least the portion of the audio data comprised in the first section to provide an audio data frame having the at least one metadata component embedded therein at the offset position;

generating an audio stream comprising at least the audio data frame; and communicating the audio stream to one or more audio rendering elements to playback the at least a portion of the audio data.

18. The computer implemented method according to claim 17, further comprising advertising a metadata format identification indicating that the codec frame having the predetermined length and comprising the first and second separated sections is supported by a computing device.

19. The computer implemented method according to claim 18, further comprising communicating an acknowledgment indicating support of the codec frame having the predetermined length and comprising the first and second separated sections.

* * * * *